US007681413B2

(12) United States Patent
Baum

(10) Patent No.: US 7,681,413 B2
(45) Date of Patent: Mar. 23, 2010

(54) RING SHANK REINFORCEMENT

(75) Inventor: Robert A. Baum, Long Island City, NY (US)

(73) Assignee: Samuel Aaron, Inc., Long Island City, NY (US)

( * ) Notice: Subject to any disclaimer, the term of this patent is extended or adjusted under 35 U.S.C. 154(b) by 344 days.

(21) Appl. No.: 11/444,661

(22) Filed: Jun. 1, 2006

(65) Prior Publication Data

US 2008/0047299 A1 Feb. 28, 2008

(51) Int. Cl.
*A44C 9/00* (2006.01)

(52) U.S. Cl. ..... 63/15; 63/15.7; 29/896.412

(58) Field of Classification Search ..... 29/896.412
See application file for complete search history.

(56) References Cited

U.S. PATENT DOCUMENTS

| | | | | | |
|---|---|---|---|---|---|
| 2,140,396 | A | * | 12/1938 | Whitaker | 63/15 |
| 2,316,225 | A | * | 4/1943 | De De Hoffman et al. | 63/29.1 |
| 2,653,402 | A | * | 9/1953 | Bonagura | 40/662 |
| 3,214,939 | A | * | 11/1965 | Monahan | 63/15.6 |
| 3,483,718 | A | | 12/1969 | Lodrini | |
| 3,736,770 | A | | 6/1973 | Kelrick | |
| 4,796,442 | A | * | 1/1989 | Sarcona | 63/26 |
| 2006/0107527 | A1 | | 5/2006 | Tye | |

* cited by examiner

*Primary Examiner*—Jack W. Lavinder

(57) ABSTRACT

A jewelry product whose ring shank is strengthened after ring sizing by securing a protective reinforcement plate made of a material to a recess in the ring shank. The ring shank is less susceptible to wear from abrasion than is the ring shank. The ring shank may have a decorative portion facing outwardly located diametrically opposite the recessed portion. An insert may be seated about the decorative portion.

17 Claims, 3 Drawing Sheets

RING SHANK REINFORCEMENT

BACKGROUND OF THE INVENTION

The present invention relates to reinforcing or strengthening a ring shank.

It is known to adjust a ring shank size to fit on a wearer's finger. One conventional ring sizing process involves sawing the ring shank at a location diametrically opposite the decorative portion of the ring to form a cut, filing the ring shank at the cut until enough material is removed to attain a desired size of the wearer and then soldering together opposite sides of the cut.

The ring sizing process itself is known to cause physical changes to occur to the ring shank. For instance, there is usually a reduction in the shank dimension where the sizing process took place. Such reduction further weakens the ring shank than would otherwise be the case. The texture of the ring shank appearance may become altered in that it may no longer match as before, particularly if the sizing process causes the formation of visible solder seam lines, cold solder joints, incomplete solder joints or pits in the solder seam. Indeed, the inside contour of the ring may no longer be perfectly round after sizing.

It would therefore be desirable to form the ring shank in a manner to address undesired alterations to the ring shank appearance attributed to the ring sizing process. That is, to make provision for strengthening the ring shank after ring sizing and for hiding seams from view should they arise from the ring sizing process. It is further desirable to increase the wear of a ring shank by rendering it less susceptible to wear from abrasion.

BRIEF SUMMARY OF THE INVENTION

One aspect of the invention relates to formation of a recess in a metal ring shank. The recess has portions configured to engage with fasteners to secure a protective reinforcement plate to the recess. The plate should be of a harder metal than that of the ring shank. Its dimension is such that when positioned in the recess of the ring shank, it not only covers, strengthens and protects the underlying ring shank from wear due to abrasion, but also hides imperfections that may be present in the ring shank, such as seams that may remain as a result of the ring sizing process.

BRIEF DESCRIPTION OF THE DRAWINGS

For a better understanding of the present invention, reference is made to the following description and accompanying drawings wherein like numerals refer to like parts, while the scope of the invention is set forth in the appended claims.

DETAILED DESCRIPTION OF THE INVENTION

Figure 1:
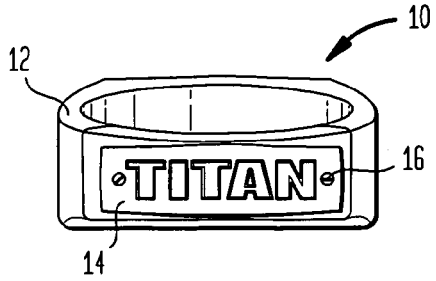
FIG. 1 is an isometric view of a ring shank to which is secured a protective reinforcement plate in accordance with the invention.
Figure 2:
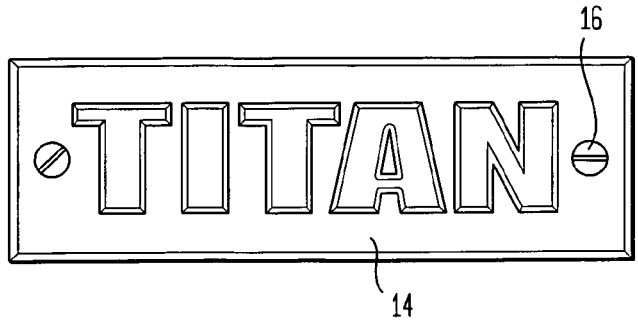
FIG. 2 is an enlarged front view of the plate with fasteners of FIG. 1.

Turning to the figures, FIG. 1 shows a ring 10 in accordance with the invention. The ring 10 includes a ring shank 12 made of a metal and a protective reinforcement plate 14 secured to the ring shank 12. The protective reinforcement plate 14 is made of a harder material than the ring shank 12 and is less susceptible to wear from abrasion than the ring shank 12, if at all. The protective reinforcement plate 14 may be secured to ring shank 12 by fasteners 16, such as screws. If desired, the protective reinforcement plate 14 may have raised or recessed lettering or other kinds of indicia. FIG. 2 shows an enlargement of the protective reinforcement plate 14 with fasteners 16.

Figure 3:
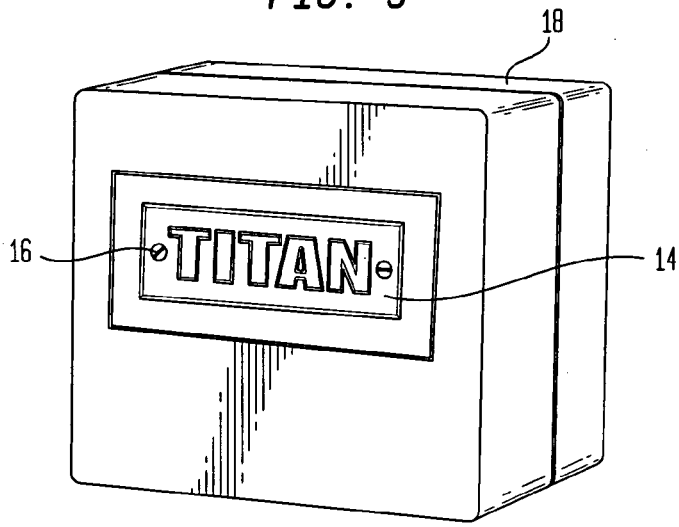
FIG. 3 is an isometric view of a container with the plate and fasteners of FIG. 2.

FIG. 3 exemplifies a container or box 18 to contain the ring 10. The box 18 may have the protective reinforcement plate 14 of FIG. 2 (or an identical plate) secured to it.

Figure 4:
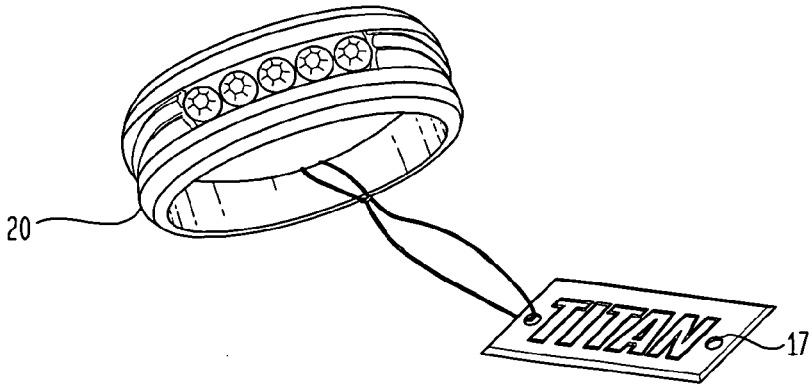
FIG. 4 is an isometric view of a ring with the plate of FIG. 2 held with an elastic band to the ring shank.

FIG. 4 shows a ring 20 to which is tied the protective reinforcement plate 14. The protective reinforcement plate 14 is preferably elongated and has two holes or apertures 17 spaced apart from each other. The distance between the two holes or apertures 17 substantially matches the distance between threaded holes in the outer facing surface of the ring shank 12 so that they align to enable insertion of the fasteners 16 through the two holes or apertures 17 to secure to the ring shank 12 in the manner of FIG. 1. In FIG. 4, the tying may be done after ring sizing is complete to allow the wearer to try on the ring to verify proper sizing and fit before the protective reinforcement plate 14 is fastened.

Figure 5:
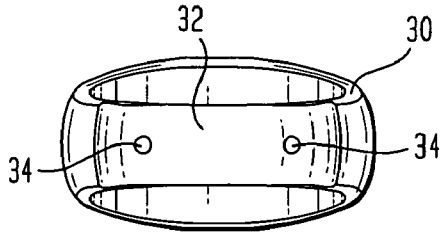
FIG. 5 is a bottom view of a further ring shank configured to hold the plate of FIG. 2.

FIG. 5 shows a ring shank 30 in accordance with a further embodiment. A recessed portion 32 is curved in a circumferential direction of the ring shank 12. The protective reinforcement plate 14 is configured to be bent or curved to fit onto the recessed portion 32. The recessed portion 32 includes threaded recesses 34 to receive the fasteners 16 exemplified by screws. The recessed portion 32 may be formed at the time the metal is cast for the ring or may be made later by filing material until a desired depth for the recess is attained to accommodate the thickness of the protective reinforcement plate 14.

Figure 8:
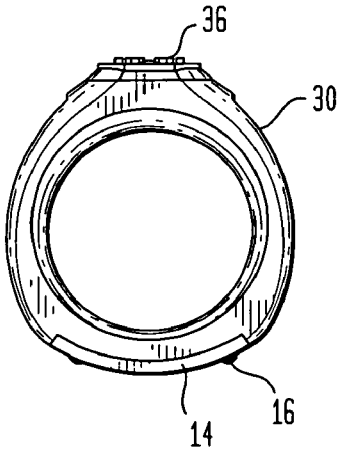
FIG. 8 is a front view as in FIG. 6, but after the plate is secured.
Figure 6:
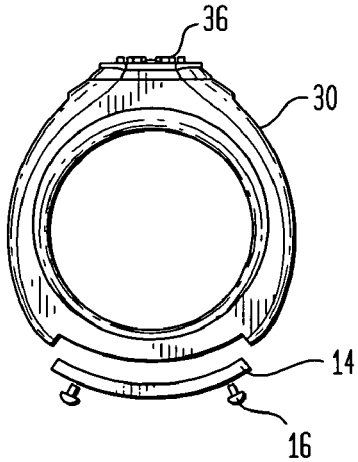
FIG. 6 is a front view thereof, but with the plate of FIG. 2 being secured.
Figure 7:
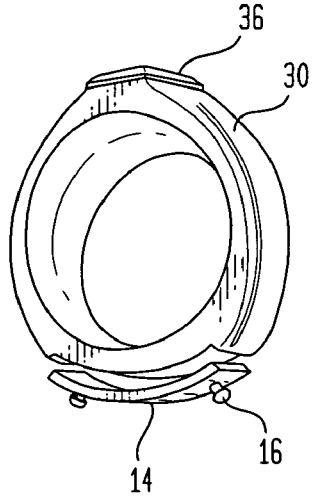
FIG. 7 is an isometric view of FIG. 6.
Figure 9:
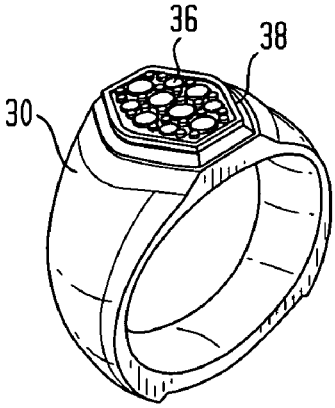
FIG. 9 is an isometric view of the further ring shank of FIG. 5 to show the top after securing an insert to the top.
Figure 10:
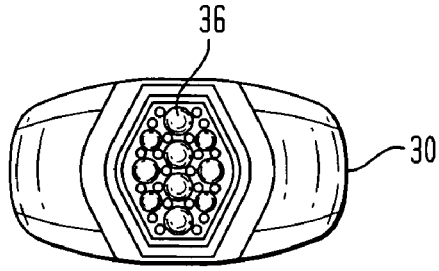
FIG. 10 is a top view of FIG. 9.
Figure 11:
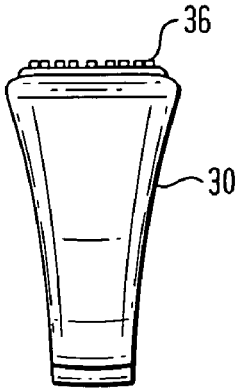
FIG. 11 is a left side view of FIG. 9, which is symmetric to the right side thereof.
Figure 12:
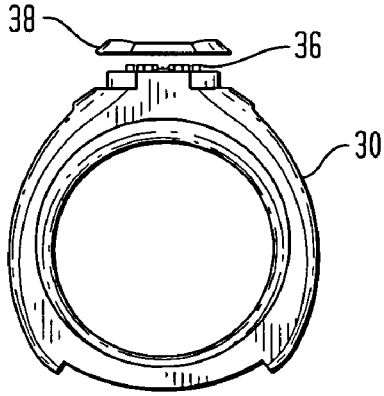
FIG. 12 is a front view of FIG. 9 prior to securement of the insert.
Figure 13:
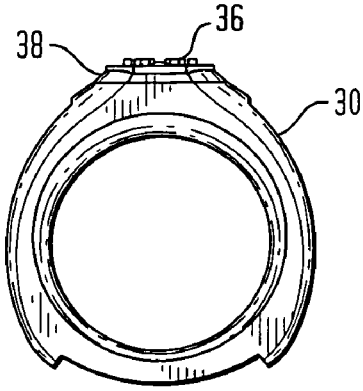
FIG. 13 is a front view as in FIG. 10, but after the insert is secured.
Figure 14:
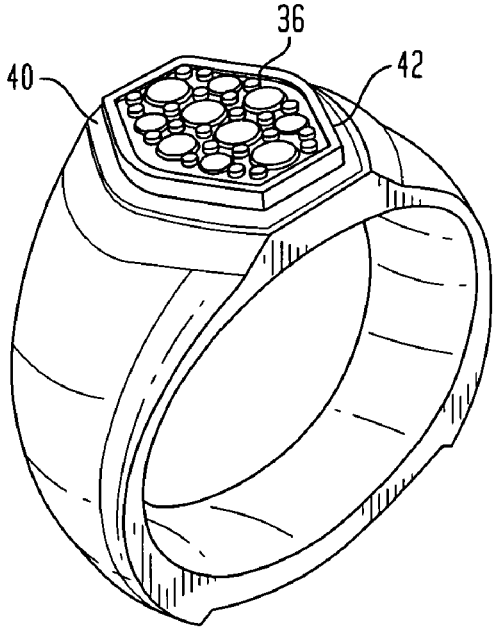
FIG. 14 is an isometric view as in FIG. 9, but without the insert seated.

FIGS. 6-8 show the manner of securing the protective reinforcement plate 14 to the recessed portion 32 with the fasteners 16. The two holes or apertures 17 of the protective reinforcement plate 14 (see FIG. 4) are spaced apart from each other to be substantially the same distance apart as, and thereby align with, the threaded recesses 34 when the protective reinforcement plate 14 is curved or bent to conform to the contour of the recessed portion 32. Diametrically opposite to the recessed portion 32 is a decorative portion 36. The decorative portion 36 may be made of precious metal or have a setting for retaining precious stones.

The ring shank 30 is cast using any conventional metal casting techniques. The protective reinforcement plate 14 is of different material from that of the ring shank 30 and is stamped using any conventional metal stamping techniques. The protective reinforcement plate 14 is screwed into the threaded recesses 34 in the underside of the ring shank 30 using a conventional jeweler's screwdriver.

The purpose of the protective reinforcement plate 14 is to reinforce the bottom of the ring shank 30, to protect the outer facing surface of the shank 30 and to cover any seam line after ring sizing. The purpose of the fasteners 16, such as screws, is to attach the protective reinforcement plate 14 to the ring shank 30 and to allow for removal of the protective reinforcement plate 14 before ring sizing.

After ring sizing, a new plate may be used that is sized to fit into the recessed portion 32 with holes or apertures drilled into it in alignment with where the threaded recesses 34 are positioned relative to each other. Alternatively, the same protective reinforcement plate 14 could be used, but it may be necessary to enlarge the holes to ensure alignment for the fasteners 16 with the threaded recesses 34.

The bottom of a ring shank 30 is the area that has greatest wear and potential damage from abrasion. By securing the protective reinforcement plate 14 to the recessed portion 32 with fasteners 16 in a releasable manner as described previously, the result will be a longer wearing ring. The ring shank 30 may be silver, the protective reinforcement plate 14 may be titanium, and the fasteners 16, such as screws, may be steel. Thus, both the ring shank 30 and the protective reinforcement plate 14 may be made of different kinds of metals, whether precious or non-precious metals.

As seen in FIGS. 9-14, the decorative portion 36 may be raised to seat a surrounding insert 38 in a seat 40. The seat 40 is adjacent a raised surface 42 that extends around the outer periphery of the decorative portion 36. The insert 38 may be friction fit on the seat or soldered or fastened with fasteners 16 to the ring shank, depending upon how one chooses to retain the insert 38 on the seat 40.

If desired, instead of the protective reinforcement plate 14 having two holes or apertures 17, it could have a single hole or aperture centrally located. Thus, the recessed portion 32 of the ring shank 30 may have a single formation centrally located and configured to align and engage with a single fastener 16 that extends through the one hole or aperture in the protective reinforcement plate 14.

While the foregoing description and drawings represent the preferred embodiments of the present invention, it will be understood that various changes and modifications may be made without departing from the scope of the present invention.

What is claimed is:

1. A jewelry product, comprising:

a ring shank configured of metal and susceptible to wear from abrasion while worn, the ring shank having a recess that is elongated in a direction of circumference of the ring shank, the recess having at least one formation configured to engage with at least one fastener so as to secure a protective reinforcement plate to the recess in a releasable manner; and a protective reinforcement plate secured to the recess, the protective reinforcement plate being of a material harder than that of the ring shank.

2. The jewelry product of claim 1, wherein the protective reinforcement plate has one of raised and recessed lettering.

3. The jewelry product of claim 1, wherein the protective reinforcement plate and the ring shank are formed of different kinds of metals.

4. The jewelry product of claim 1, further comprising at least one fastener that secures the protective reinforcement plate to the formation by engagement, the protective reinforcement plate having at least one aperture through which the fastener extends.

5. The jewelry product of claim 1, wherein the protective reinforcement plate and the recess are configured to be securable to each other to accommodate changes in size of the ring shank after ring sizing.

6. A jewelry product, comprising:

a ring shank configured of metal and susceptible to wear from abrasion while worn, the ring shank having a recess that is elongated in a direction of circumference of the ring shank, the recess having at least one formation configured to engage with at least one fastener so as to secure a protective reinforcement plate to the recess in a releasable manner;

a container that contains the ring shank inside; and a protective reinforcement plate secured to an outer surface of the container in a removable manner and configured to be secured to the recess of the ring shank.

7. A jewelry product, comprising:

a ring shank configured of metal and susceptible to wear from abrasion while worn, the ring shank having a recess that is elongated in a direction of circumference of the ring shank, the recess having at least one formation configured to engage with at least one fastener so as to secure a protective reinforcement plate to the recess in a releasable manner; and a protective reinforcement plate tied to the ring shank, the protective reinforcement plate being of a material harder than that of the ring shank.

8. A method of assembling a jewelry product, comprising the steps of:

configuring a ring shank of metal that is susceptible to wear from abrasion while worn, the ring shank having a recess that is elongated in a direction of circumference of the ring shank;

providing the recess with at least one formation configured to engage with at least one fastener so as to secure a protective reinforcement plate to the recess in a releasable manner; and securing a protective reinforcement plate to the recess, the protective reinforcement plate being of a material harder than that of the ring shank.

9. The method of claim 8, further comprising using at least one fastener to secure the protective reinforcement plate to the formation by engagement; and extending the fastener through at least one aperture in the protective reinforcement plate.

10. A method of assembling a jewelry product, comprising the steps of:

configuring a ring shank of metal that is susceptible to wear from abrasion while worn, the ring shank having a recess that is elongated in a direction of circumference of the ring shank;

providing the recess with at least one formation configured to engage with at least one fastener so as to secure a protective reinforcement plate to the recess in a releasable manner;

securing a protective reinforcement plate to the recess, the protective reinforcement plate being of a material harder than that of the ring shank; and seating an insert around a decorative portion of the ring shank, the decorative portion being diametrically opposite the recess and facing outwardly.

11. A method of assembling a jewelry product, comprising the steps of:

configuring a ring shank of metal that is susceptible to wear from abrasion while worn, the ring shank having a recess that is elongated in a direction of circumference of the ring shank;

providing the recess with at least one formation configured to engage with at least one fastener so as to secure a protective reinforcement plate to the recess in a releasable manner;

securing a protective reinforcement plate to the recess, the protective reinforcement plate being of a material harder than that of the ring shank;

removing the protective reinforcement plate from the recess, sizing the ring shank to fit a wearer's finger by cutting the ring shank;

removing metal from the ring shank to form a gap;

joining the ring shank together to close the gap; and retaining the protective reinforcement plate to the recess after the joining.

12. The method of claim 11, wherein the protective reinforcement plate has at least one aperture, the securing being carried out by inserting the at least one fastener through the at least one aperture and into the at least one formation to engage same.

13. The method of claim 12, wherein the retaining is carried out by inserting the at least one fastener through the at least one aperture and into the at least one formation to engage same.

14. The method of claim 13, further comprising providing the ring shank and the protective reinforcement plate are configured to be securable to each other to accommodate changes in size of the ring shank.

15. The method of claim 13, wherein the at least one aperture is widened prior to carrying out the step of retaining.

16. The method of claim 11, further comprising creating a seam adjacent the recess that extends inwardly as a result of the joining.

17. A method of assembling a jewelry product, comprising the steps of:

configuring a ring shank of metal that is susceptible to wear from abrasion while worn, the ring shank having a recess that is elongated in a direction of circumference of the ring shank;

providing the recess with at least one formation configured to engage with at least one fastener so as to secure a protective reinforcement plate to the recess in a releasable manner;

securing a protective reinforcement plate to the recess, the protective reinforcement plate being of a material harder than that of the ring shank; and removing the protective reinforcement plate from a secured position on a container that contains the ring shank and removing the ring shank from inside the container; thereafter carrying out the securing step.

* * * * *